US012129585B2

(12) United States Patent
Gupta

(10) Patent No.: US 12,129,585 B2
(45) Date of Patent: Oct. 29, 2024

(54) THREAD CONDITIONER AND CUTTER

(71) Applicant: Nikhil Gupta, Schaumburg, IL (US)

(72) Inventor: Nikhil Gupta, Schaumburg, IL (US)

( * ) Notice: Subject to any disclaimer, the term of this patent is extended or adjusted under 35 U.S.C. 154(b) by 495 days.

(21) Appl. No.: 17/588,818

(22) Filed: Jan. 31, 2022

(65) Prior Publication Data

US 2022/0251778 A1 Aug. 11, 2022

Related U.S. Application Data

(60) Provisional application No. 63/146,002, filed on Feb. 5, 2021.

(51) Int. Cl.
*D05B 67/00* (2006.01)
*D05B 37/04* (2006.01)

(52) U.S. Cl.
CPC ..... *D05B 67/00* (2013.01); *D05B 37/04* (2013.01)

(58) Field of Classification Search
CPC ..... D05B 37/04; D05B 67/00; B26D 1/02; B26D 1/025; B26D 1/445; B26D 2007/0012; B26D 7/01; B26D 7/08; B26D 7/20; B26D 7/27; B26D 7/088; B26D 2007/0087; D02G 1/10; D02G 1/20; D02J 1/16; D02J 3/02; D02J 3/14; D02J 7/00; D02J 11/00; Y10T 83/9493; B65H 54/71
USPC ..... 28/217, 222, 223, 226; 83/856
See application file for complete search history.

(56) References Cited

U.S. PATENT DOCUMENTS 516,964 A * 3/1894 Clibborn ..... C23C 2/22 118/DIG. 22
686,461 A * 11/1901 Keats ..... B65H 71/005 118/78
839,567 A * 12/1906 Emerson ..... B65H 71/005 118/78
1,128,663 A * 2/1915 Conness ..... B26B 27/00 83/856
1,349,627 A * 8/1920 Peterson ..... B26B 27/00 83/662
1,659,956 A * 2/1928 Matthews ..... B65H 63/061 28/235

(Continued)

FOREIGN PATENT DOCUMENTS

CN 111302154 A * 6/2020
EP 253934 A1 * 1/1988

*Primary Examiner* — Amy Vanatta
(74) *Attorney, Agent, or Firm* — Dunlap Bennett & Ludwig PLLC; Anna L. Kinney

(57) ABSTRACT

A thread conditioner and cutter includes (a) a base unit with (i) a planar divider for supporting a thread conditioning composition; (ii) a plurality of upper sidewall segments spaced apart from each other to define upper slots extending upwardly from the planar divider as well as defining an upper cavity of the base unit; (iii) a lower sidewall extending downwardly from the planar divider thereby defining an underside cavity, wherein the lower sidewall has a plurality of opposing thread notches at an upper edge thereof at a lower end of the upper slots of the upper sidewall segments as well as a pair of opposing lower slots extending upwardly from a lower edge of the lower sidewall; and (iv) a cutting blade disposed at one of said opposing slots at a first distance from the lower edge of the lower sidewall and wherein the slot opposed to the slot with the cutting blade extends a second distance from the lower edge of the lower sidewall which is greater than the first distance from the lower edge of the lower sidewall of the cutting blade.

15 Claims, 4 Drawing Sheets

(56) References Cited

U.S. PATENT DOCUMENTS 1,856,882 A * 5/1932 Myers ..... D05B 67/00 118/DIG. 22
2,232,441 A * 2/1941 Duraffourg ..... B65H 63/061 28/235
2,446,383 A * 8/1948 Motz ..... D05C 1/065 223/107
2,624,933 A * 1/1953 Quick ..... B65H 63/061 28/235
2,654,938 A * 10/1953 Robert ..... B65H 63/061 28/235
2,846,705 A * 8/1958 Marz ..... A01K 97/00 15/210.1
2,887,117 A * 5/1959 Rosholt ..... A45D 40/02 401/262
2,897,774 A * 8/1959 Alexander ..... D05B 67/00 112/256
3,025,584 A * 3/1962 Evans ..... D02G 1/10 57/248
3,479,988 A * 11/1969 Trost ..... B65H 71/005 118/78
3,504,488 A * 4/1970 Illman ..... B65H 54/71 57/22
4,501,222 A * 2/1985 Stone ..... B05C 1/06 43/25
5,097,733 A * 3/1992 Benkoski ..... B26D 1/02 83/440.2
5,564,173 A * 10/1996 Sedman ..... D02J 7/00 28/232
5,839,342 A * 11/1998 Cope ..... B65H 54/71 83/639.1
9,982,377 B2 5/2018 Gupta et al.
2006/0090352 A1* 5/2006 Kaposi ..... B26D 3/185 30/299
2014/0182441 A1* 7/2014 Pisczak ..... B23D 35/001 83/694
2018/0237969 A1 8/2018 Gupta et al.
2023/0134474 A1* 5/2023 Dumoulin ..... D02J 3/02 28/222

* cited by examiner

THREAD CONDITIONER AND CUTTER

CLAIM FOR PRIORITY

This application is based on U.S. Provisional Application No. 63/146,002 of the same title filed Feb. 5, 2021, the priority of which is hereby claimed and the disclosure of which is incorporated herein by reference.

TECHNICAL FIELD

The present invention relates to dispensers for thread conditioning compositions and thread cutting devices.

BACKGROUND

Dispensers for thread treatment compositions are known in the art. See U.S. Pat. No. 9,982,377 to Gupta et al. Such devices are often used in cluttered environments when a user is undertaking multiple tasks. Covers or caps for the devices can become misplaced. So, also, treated thread needs to be cut and locating an appropriate tool may be inconvenient and time consuming.

SUMMARY OF INVENTION

There is provided in accordance with the present invention a thread conditioner and cutter where a cap is tethered to a base unit and a cutting blade is provided in an underside cavity of the base opposite a slot enabling downward tension of the treated thread against the blade in order to sever the thread.

In particular, there is provided in accordance with the present invention a thread conditioner and cutter comprising: (a) a base unit with (i) a planar divider for supporting a thread conditioning composition; (ii) a plurality of upper sidewall segments spaced apart from each other to define upper slots extending upwardly from the planar divider as well as defining an upper cavity of the base unit; (iii) a lower sidewall extending downwardly from the planar divider thereby defining an underside cavity, wherein the lower sidewall has a plurality of opposing thread notches at an upper edge thereof at a lower end of the upper slots of the upper sidewall segments as well as a pair of opposing lower slots extending upwardly from a lower edge of the lower sidewall; and (iv) a cutting blade disposed at one of said opposing slots at a first distance from the lower edge of the lower sidewall and wherein the slot opposed to the slot with the cutting blade extends a second distance from the lower edge of the lower sidewall which is greater than the first distance from the lower edge of the lower sidewall of the cutting blade and (b) a cap adapted to mate with the base unit and enclose the upper cavity of the base unit, such that the upper slots are covered when the cap is mated with the base unit.

Still further features and advantages are apparent from the following description and appended drawings.

BRIEF DESCRIPTION OF THE DRAWINGS

The invention is described in detail below with reference to the appended drawings, wherein like numerals designate similar parts and wherein.

DETAILED DESCRIPTION

Figure 1:
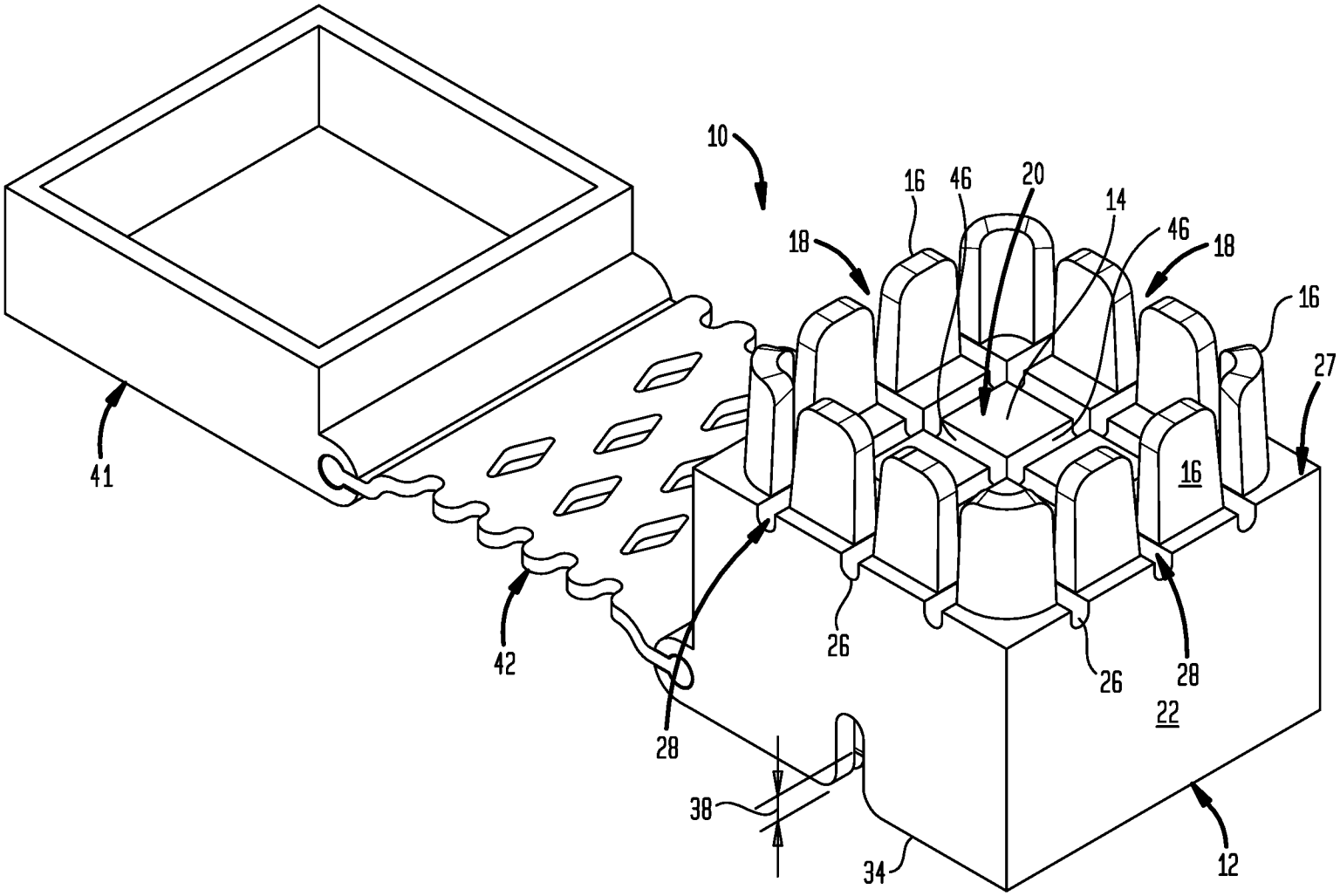
FIG. 1 is a top perspective view of a thread conditioner and cutter in an open position with a cap removed from the base.
Figure 2:
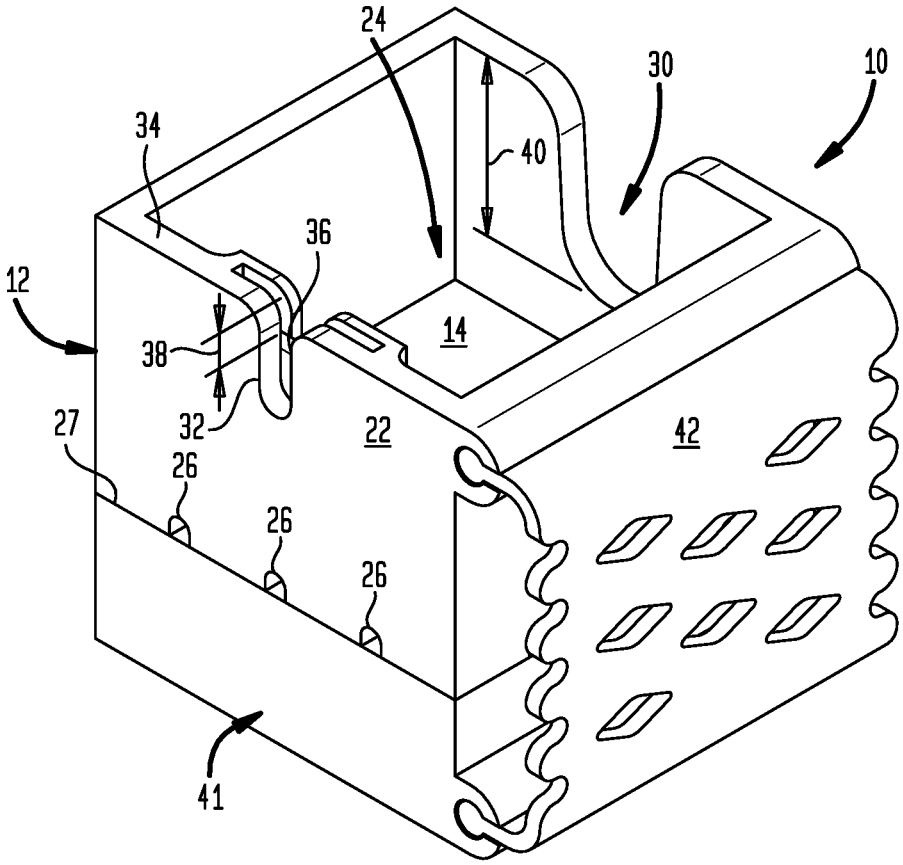
FIG. 2 is a bottom perspective view of the thread conditioner with the cap installed on the base.
Figure 3:
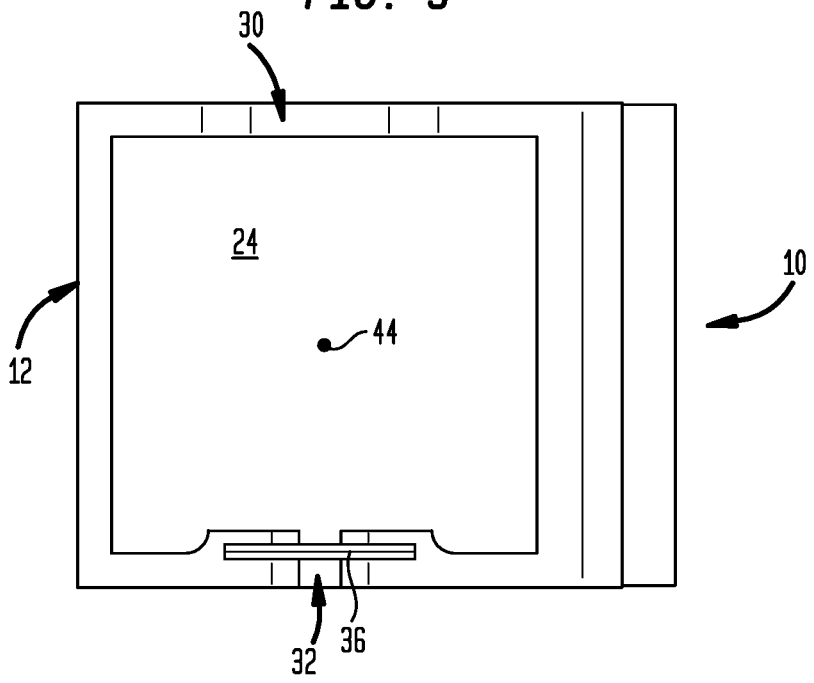
FIG. 3 is a bottom plan view of the thread conditioner and cutter.

Referring to the drawings, there is illustrated a thread conditioner and cutter 10 comprising: a base unit 12 with a planar divider 14 for supporting a thread conditioning composition; a plurality of upper sidewall segments 16 spaced apart from each other to define a plurality of upper slots 18 extending upwardly from the planar divider as well as an upper cavity 20 of the base unit; a lower sidewall 22 extending downwardly from planar divider 14 thereby defining an underside cavity 24. Lower sidewall 22 has a plurality of opposing thread notches 26 at an upper edge 27 thereof at a lower end 28 of upper slots 18 of the upper sidewall segments, as well as a pair of opposing lower slots 30, 32 extending upwardly from a lower edge 34 of lower sidewall 22. A cutting blade 36 is disposed at opposing slot 32 at a first distance 38 from lower edge 34 of lower sidewall 22 and the slot opposed to the slot with the cutting blade, slot 30 extends a second distance 40 from lower edge 34 of lower sidewall 22 which is greater than first distance 38 from lower edge 34 of lower sidewall 22 to the cutting blade.

A cap 41 is removably mated with the base unit and encloses the upper cavity of the base unit when installed, such that upper slots 18 are covered when the cap is mated with the base unit. Cap 41 is tethered to the base unit with a flexible web 42 which may be made of a soft or elastomeric polymer film and most preferably has a perforate construction.

As is seen in the various Figures, slot 30 is opposed to slot 32 with the cutting blade. In particular, slot 30 with the cutting blade opposes slot 32 through a center 44 of the planar divider. Second distance 40 from the lower edge of the slot 30 preferably extends over a distance from the lower edge of the lower sidewall 22 a length of at least twice first distance 38 from the lower edge of the lower sidewall where the cutting blade is located in slot 32.

The planar divider comprises a plurality of channels 46 connecting a plurality of opposing notches.

Preferably, base unit 12 is of unitary construction and is made of a thermoplastic material such as acrylonitrile butadiene styrene copolymer. Cap 41 is likewise made of such materials.

While the inventive thread conditioner and cutter may be shaped and constructed in a variety of ways, a preferred construction is wherein the thread conditioner and cutter have a rectangular lateral cross-section, that is, in plan view from above or below. More preferably, the thread conditioner and cutter have a square lateral cross-section.

A most preferred construction is wherein the thread conditioner and cutter have a cubular construction as shown.

Figure 4C:
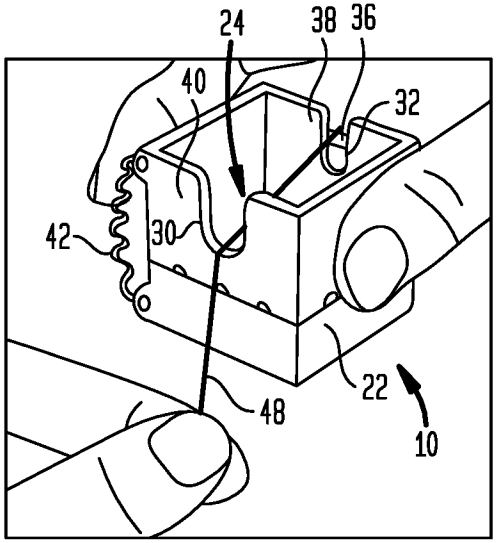
FIGS. 4A-C are illustrations showing operation of the thread conditioner and cutter.
Figure 4B:
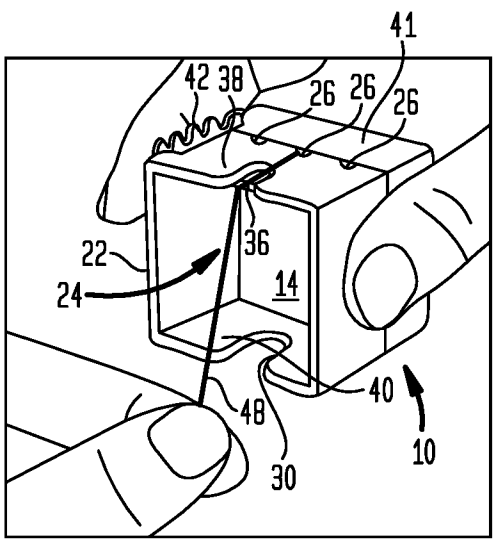
Figure 4A:
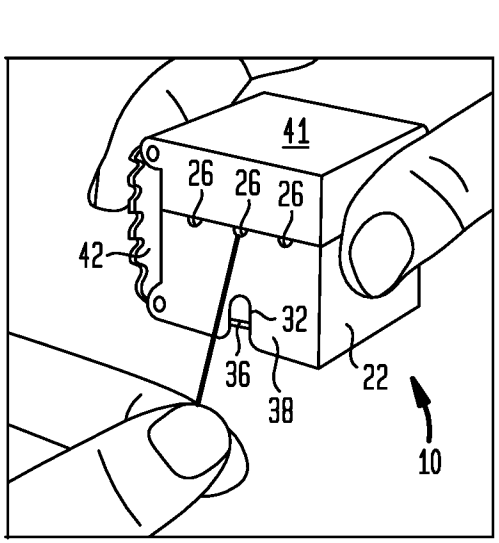

Referring to FIG. 4A, there is shown a thread 48 drawn through the thread condition and cutter at a notch 26 for treatment with a thread conditioning composition toward slot 32 and blade 36. FIG. 4B shows the thread conditioner and cuter rotated with respect to FIG. 4A, wherein the thread is pulled over the blade toward slot 30. In FIG. 4C thread 48 is pulled downwardly in slot 30 to force the thread against the blade and sever thread 48.

The inventive thread conditioner and cutter eliminates the need for a separate cutting tool which may be inconvenient to locate and use.

LISTING OF ELEMENTS

10: Thread Conditioner and Cutter
12: Base Unit
14: Planar Divider between upper and lower cavities
16: Upper Sidewall Segments
18: Upper Slots between Sidewall Segments
20: Upper Cavity on the top of Base Unit
22: Lower Sidewall of Base Unit
24: Underside Cavity of Base Unit
26: Opposing Thread Notches on upper edge of Lower Sidewall
27: Upper Edge of Lower Sidewall 22
28: Lower End of Upper Slots 18
30, 32: Opposing Lower Slots in Lower Sidewall, slot 32 has Blade
34: Lower Edge of Lower Sidewall 22
36: Cutting Blade
38: First Distance from Lower Edge of Sidewall 22 where Blade is located
40: Second Distance, or Length of slot 30 from Lower edge 34 of Sidewall 22
41: Cap
42: Flexible Web
44: Center of Planar Divider
46: Channels in upper surface of Planar Divider
48: Thread

What is claimed is:

1. A thread conditioner and cutter comprising:

(a) a base unit with (i) a planar divider for supporting a thread conditioning composition; (ii) a plurality of upper sidewall segments spaced apart from each other to define upper slots extending upwardly from the planar divider as well as defining an upper cavity of the base unit; (iii) a lower sidewall extending downwardly from the planar divider thereby defining an underside cavity, wherein the lower sidewall has a plurality of opposing thread notches at an upper edge thereof at a lower end of the upper slots of the upper sidewall segments as well as a pair of opposing lower slots extending upwardly from a lower edge of the lower sidewall; and (iv) a cutting blade disposed at one of said opposing slots at a first distance from the lower edge of the lower sidewall and wherein the slot opposed to the slot with the cutting blade extends a second distance from the lower edge of the lower sidewall which is greater than the first distance from the lower edge of the lower sidewall of the cutting blade;

(b) a cap adapted to mate with the base unit and enclose the upper cavity of the base unit, such that the upper slots are covered when the cap is mated with the base unit.

2. The thread conditioner and cutter according to claim 1, wherein the cap is tethered to the base unit with a flexible web.

3. The thread conditioner and cutter according to claim 2 wherein the flexible web is made of a soft or elastomeric polymer.

4. The thread conditioner and cutter according to claim 3, wherein the flexible web has a perforate construction.

5. The thread conditioner and cutter according to claim 1, wherein the slot opposed to the slot with the cutting blade is opposed to the slot with the cutting blade through a center of the planar divider.

6. The thread conditioner and cutter according to claim 1, wherein the second distance from the lower edge of the slot opposed to the cutting blade extends over a distance from the lower edge of the lower sidewall of at least twice the first distance from the lower edge of the lower sidewall where the cutting blade is located.

7. The thread conditioner and cutter according to claim 1, wherein the planar divider comprises a plurality of channels connecting the plurality of opposing notches.

8. The thread conditioner and cutter according to claim 1, wherein the base unit is of unitary construction.

9. The thread conditioner and cutter according to claim 1, wherein the base unit is made of a thermoplastic material.

10. The thread conditioner and cutter according to claim 9, wherein the thermoplastic material is acrylonitrile butadiene styrene copolymer.

11. The thread conditioner and cutter according to claim 1, wherein the cap is made of a thermoplastic material.

12. The thread conditioner and cutter according to claim 11, wherein the thermoplastic material is acrylonitrile butadiene styrene copolymer.

13. The thread conditioner and cutter according to claim 1, wherein the thread conditioner and cutter has a rectangular lateral cross-section.

14. The thread conditioner and cutter according to claim 13, wherein the thread conditioner and cutter has a square lateral cross-section.

15. The thread conditioner and cutter according to claim 14, wherein the thread conditioner and cutter has a cubular construction.

* * * * *